US006164221A

United States Patent [19]

Facchiano et al.

[11] Patent Number: 6,164,221

[45] Date of Patent: Dec. 26, 2000

[54] METHOD FOR REDUCING UNBURNED CARBON IN LOW NOX BOILERS

[75] Inventors: Anthony Facchiano, San Carlos; Richard A. Brown, Sunnyvale; Wate T. Bakker, Saratoga, all of Calif.; Robert R. Hardman, Gulfport, Miss.

[73] Assignee: Electric Power Research Institute, Inc., Palo Alto, Calif.

[21] Appl. No.: 09/223,590

[22] Filed: Dec. 30, 1998

Related U.S. Application Data

[63] Continuation-in-part of application No. 09/100,188, Jun. 18, 1998, Pat. No. 6,085,673.

[51] Int. Cl.[7] ..... F23N 1/02

[52] U.S. Cl. ..... 110/347; 110/345; 110/186; 110/218; 110/191; 431/12

[58] Field of Search ..... 110/185, 186, 110/188, 191, 342, 344, 341, 348, 165 A, 345, 347, 218; 431/12, 10, 79, 2; 122/392

[56] References Cited

U.S. PATENT DOCUMENTS

| | | | |
|---|---|---|---|
| 3,257,993 | 6/1966 | Kochey, Jr. | 122/392 |
| 3,274,979 | 9/1966 | Petit | 122/392 |
| 3,276,437 | 10/1966 | Jonakin et al. | 122/392 |
| 3,877,440 | 4/1975 | Winkin | 110/343 X |
| 4,438,709 | 3/1984 | Borio et al. . | |
| 4,528,918 | 7/1985 | Sato et al. | 431/10 X |
| 4,915,073 | 4/1990 | Harth et al. . | |
| 5,020,454 | 6/1991 | Hellewell et al. . | |
| 5,740,745 | 4/1998 | Smyrniotis et al. | 110/343 |
| 5,746,143 | 5/1998 | Vatsky . | |
| 5,774,176 | 6/1998 | Carter | 110/186 X |
| 5,809,913 | 9/1998 | Kramer et al. | 110/343 X |
| 5,988,079 | 11/1999 | Carter | 110/186 X |
| 6,045,353 | 4/2000 | VonDrasek et al. | 431/79 |

*Primary Examiner*—Carl D. Price
*Assistant Examiner*—Ljiljana V. Ciric
*Attorney, Agent, or Firm*—William S. Galliani; Pennie & Edmonds LLP

[57] ABSTRACT

The invention provides a method which includes the step of locating a burner of a low NOx boiler that produces a disproportionately high quantity of unburned carbon. The air-to-fuel ratio at the burner is then increased to decrease the percentage of unburned carbon attributable to the burner. The air-to-fuel ratio at a second burner of the low NOx boiler is reduced to maintain a substantially constant total air-to-fuel ratio in the low NOx boiler.

5 Claims, 3 Drawing Sheets

METHOD FOR REDUCING UNBURNED CARBON IN LOW NOX BOILERS

This application is a continuation-in-part of the application entitled "Method for Reducing Waterwall Corrosion in Low NOx Boilers", Ser. No. 09/100,188, filed Jun. 18, 1998, now U.S. Pat. No. 6,085,673, which issued on Jul. 11, 2000.

BACKGROUND OF THE INVENTION

1. Field of the Invention

This invention relates generally to boilers that have low NOx systems (e.g., low NOx boilers). More particularly, this invention relates to a method for reducing unburned carbon in low NOx systems.

2. Description of the Related Art

Clean air regulations require a reduction in the flue gas emissions of NOx compounds from coal-fired boilers. It is well known that NOx emissions can be reduced through a "deep staging" technique that controls coal particle burnout as it traverses from the point of origin (e.g., the burner) to the final destination (e.g., the stack). Prior art deep staging techniques endeavor to ensure that combustion air is evenly distributed among all of the burners in the boiler.

In the deep staging technique, combustion in the primary combustion zone of a boiler results in a flue gas containing a high percentage of unburned carbon (UBC) in the fly ash particles. Additional air (i.e., overfire air) is subsequently added to the upper furnace to complete the combustion and burn out the un-combusted coal particles.

The reduction in NOx emissions is generally a function of the fuel-to-air ratio during the first combustion step in the primary combustion zone. The lower the stoichiometric ratio, the larger the NOx emission reduction. Thus, there is ongoing emphasis on reducing the amount of oxygen used in the primary combustion zone so that NOx emissions can be reduced until a minimum point is reached at very fuel rich stoichiometry. Thus, there is a desire to achieve substoichiometric conditions in the primary combustion zone so that NOx emissions can be reduced. Unfortunately, this often leads to an increase in the percentage of UBC in the fly ash.

The most common method of measurement of the UBC in the fly ash is the "loss on ignition" or "LOI" test. If the percent LOI exceeds a specific quantity, typically 4–5%, the fly ash must be disposed of in an ecologically safe manner, which can be prohibitively expensive. On the other hand, if the UBC in the fly ash is at a sufficiently low value, then the fly ash can be sold as a concrete admixture, as a soil stabilizer, and as a filler for asphalt and structural materials, such as bricks.

In view of the foregoing, it would be highly desirable to provide a technique to reduce the UBC or LOI flyash byproduct from a coal-fired boiler operated in a low NOx mode. Such a technique would exploit the clean air benefits of a low NOx system, while allowing the flyash to be sold at a profit, instead of being disposed of at a considerable expense.

SUMMARY OF THE INVENTION

A method to reduce unburned carbon in a low NOx boiler includes the step of locating at least one burner of a low NOx boiler firing system that produces a disproportionately high quantity of unburned carbon. The air-to-fuel ratio at the burner is then increased to decrease the percentage of unburned carbon attributable to the burner. The air-to-fuel ratio at a second burner of the low NOx boiler firing system is reduced to maintain a substantially constant total air-to-fuel ratio in the low NOx boiler firing system.

The invention reduces unburned carbon in a low NOx boiler, while allowing the system boiler to operate with the same low NOx emissions. The fly ash generated by the boiler can be sold at a profit, instead of being disposed of at a considerable expense. Advantageously, the technique of the invention can be readily exploited in existing and future low NOx systems.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DESCRIPTION OF THE PREFERRED EMBODIMENTS

As previously indicated, prior art deep staging techniques operate on the assumption that the optimum way to minimize UBC (or LOI) in fly ash is to ensure that all of the utilized combustion air is evenly distributed among all burners in the low NOx system. The present invention takes a substantially opposite approach to deep staging. In particular, the present invention utilizes a strategic imbalance of the combustion air at various burners of the low NOx system to achieve lower UBC (or LOI), as described below.

Figure 1:
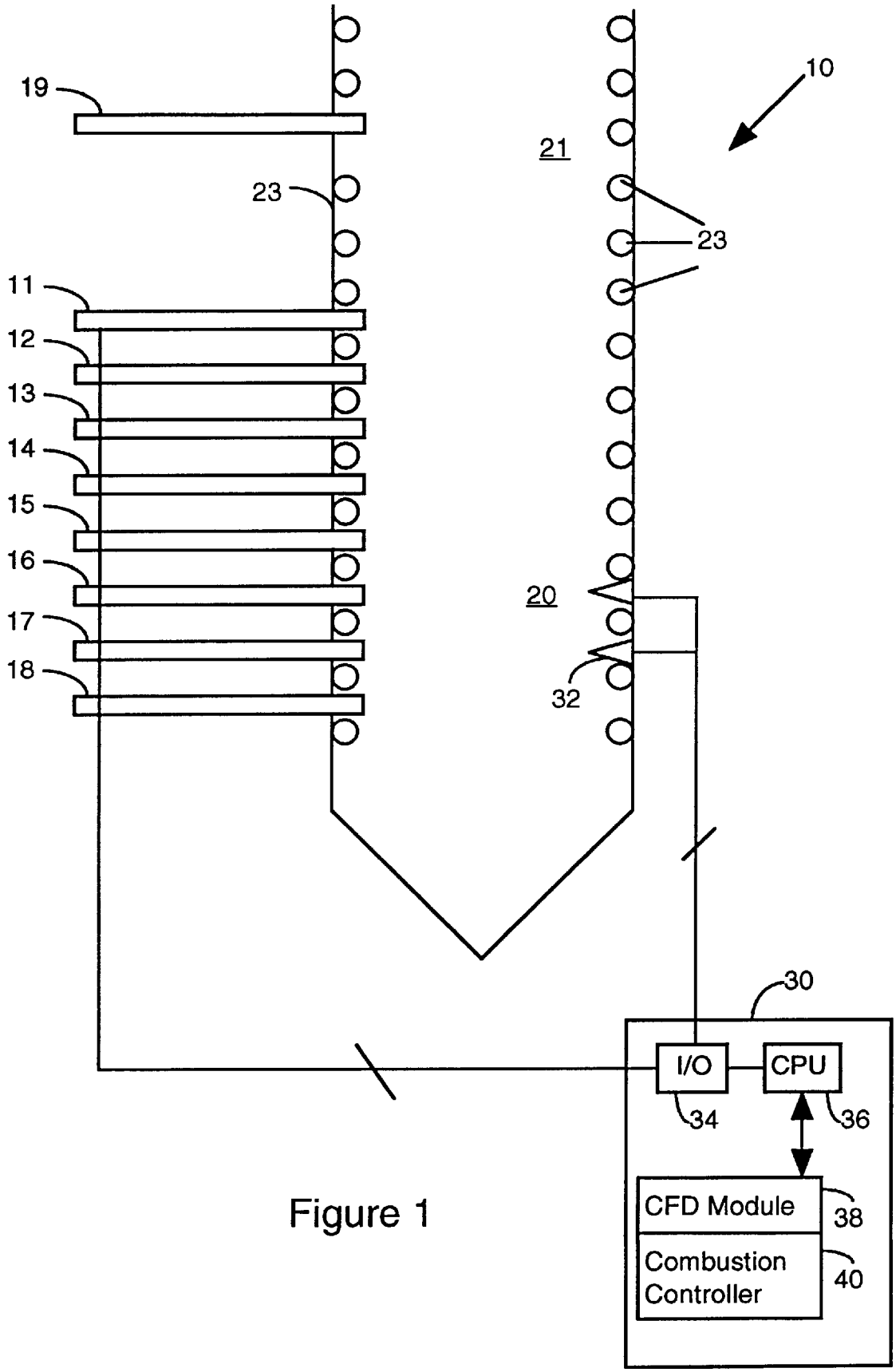
FIG. 1 illustrates a low NOx boiler that may be operated in accordance with an embodiment of the invention.

FIG. 1 is a cross-sectional view of a low NOx boiler (10) that can utilize the technique of the invention. By way of example, eight burners (11–18) are shown in the lower furnace or primary combustion zone (20). An overfire air port (19) is shown in the upper furnace (21). Waterwall tubes (23) line the inside of the boiler (10) (the tubes are shown in a horizontal configuration for convenience, but it should be understood that the tubes are generally in a vertical configuration).

Fuel is injected into the primary combustion zone (20) along with combustion air through the burners (11–18) in a set proportion known as the air-to-fuel ratio. Water contained in the waterwall tubes (23) is converted to high pressure steam, which is ultimately used to rotate a turbine (not shown).

The flue gas resulting from primary combustion flows to the upper furnace (21) where overfire air is injected through the overfire air port (19) to complete the combustion process. The flue gas then exits the boiler (10).

A computer (30) is connected to a set of sensors (32) that provide data regarding the combustion process within the boiler (10). The computer (30) includes standard input/output devices (34) for interfacing with the sensors (32) and for providing an interface with a human user. The input/output devices (34) interact with a central processing unit (CPU) (36). The CPU (36) executes a set of programs, including a three-dimensional combustion fluid dynamic module (38), as described below. The CPU (36) may also execute a combustion control program (40), which controls the operation of the burners (11)–(19) (e.g., the air-to-fuel ratio) in accordance with a combustion strategy. The computer (30) also operates in an off-line mode wherein the combustion fluid dynamic module (38) is executed, as described below.

Figure 2:
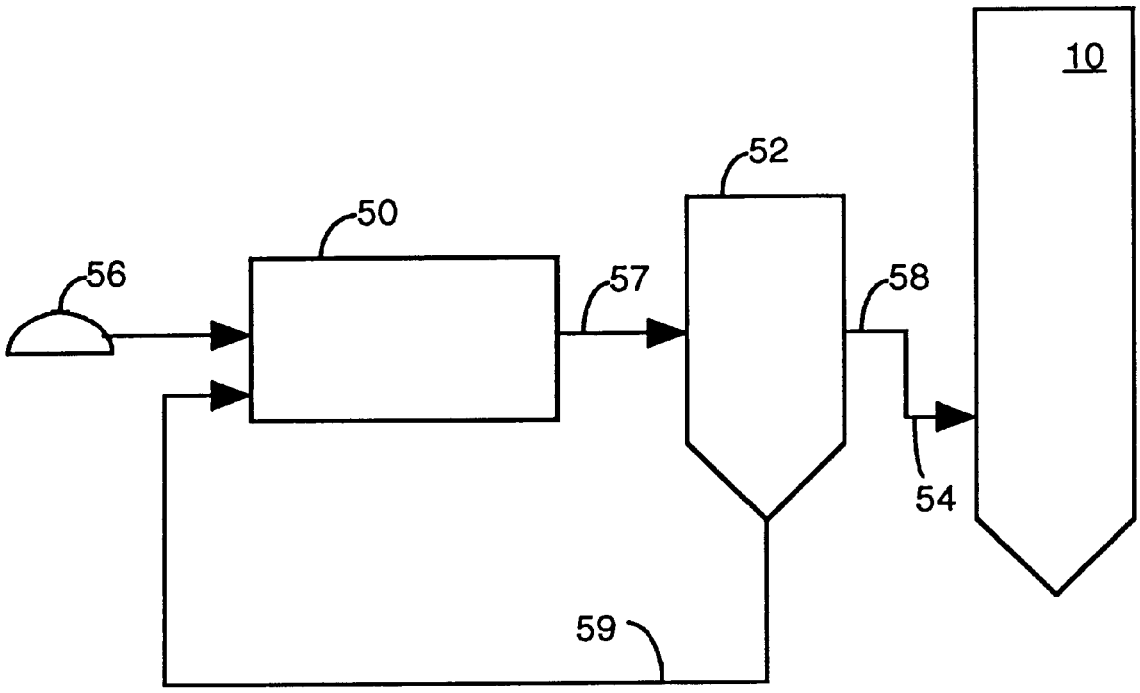
FIG. 2 illustrates a coal processing apparatus that may be used to implement the method of the invention.

FIG. 2 is a flow schematic of a coal mill (50) and a classifier (52) for one burner (54). It should be noted that a single coal mill can feed more than one burner. Coal (56) is fed to a coal mill (50), and the resulting ground product stream (57) is fed to a classifier (52) where the ground product is separated into the burner feed stream (58) and a recycle stream (59). The burner feed stream (58) is fed to the burner (54), and the recycle stream (59) is recycled to the coal mill (50). Based upon the operation of the classifier (50), the burner feed stream (58) contains smaller particles than the recycle stream (59). The particle size distinction between the burner feed stream (58) and the recycle stream (59) can be varied and is determined by the particular design criteria of the classifier (52).

FIG. 2 is a flow schematic of a coal mill (50) and a classifier (52) for one burner (54). It should be noted that a single coal mill (50) can feed more than one burner (54). Through normal adjustment on the classifier (52), the particle size distribution and percentage of fine and course material feeding the burner(s) can be modified.

Figure 3:
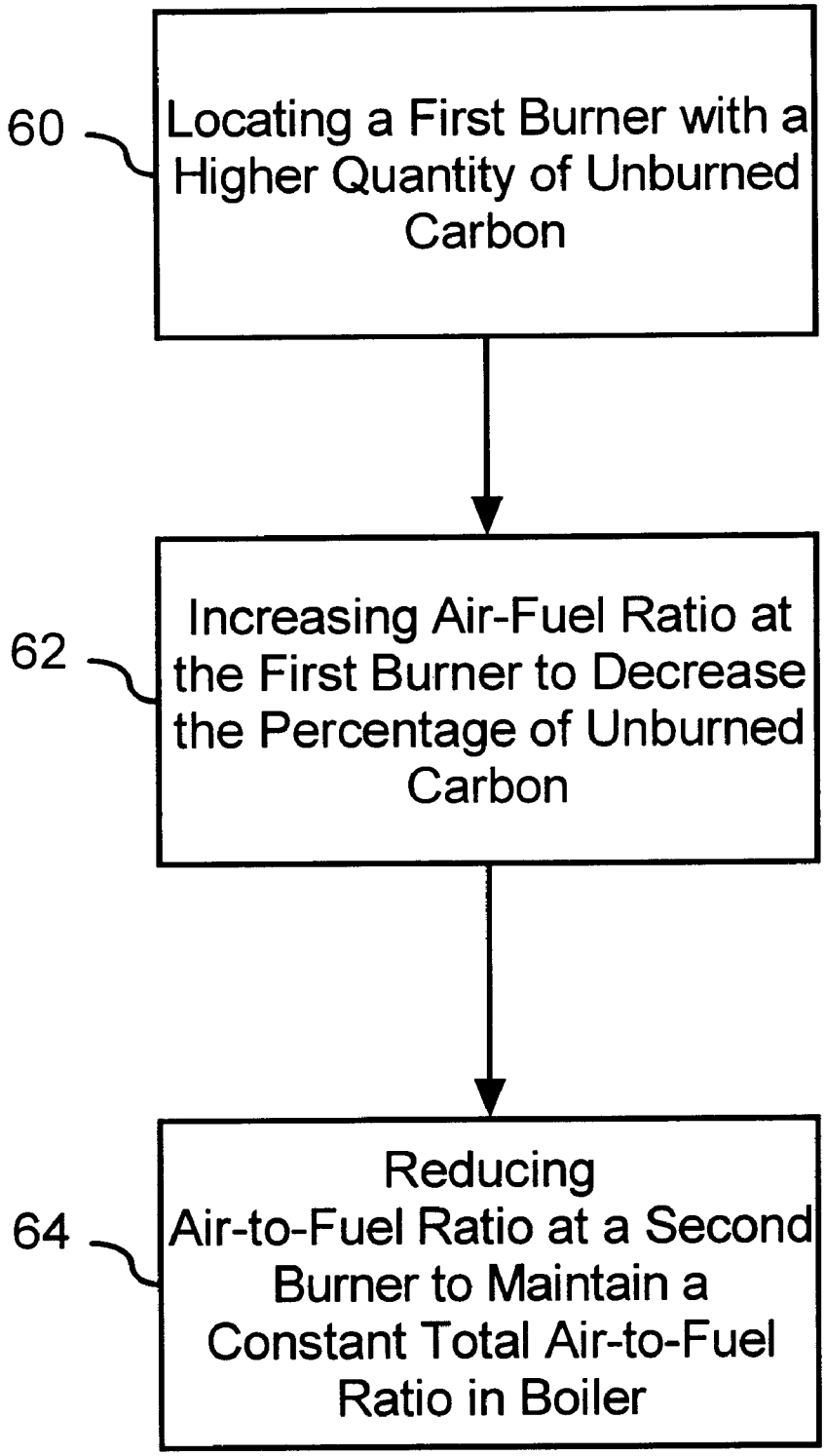
FIG. 3 illustrates processing steps performed in accordance with an embodiment of the invention.

The devices of FIGS. 1 and 2 are used in the following manner, as depicted in FIG. 3. FIG. 3 illustrates processing steps performed in accordance with an embodiment of the invention. One of the burners (11–18 of FIG. 1) from the primary combustion zone (20 of FIG. 1) is identified (step 60) as a burner that produces a disproportionately high quantity of unburned carbon. The technique for identifying such a burner is described below. After the burner is identified (step 60), the air-to-fuel ratio at the burner is increased (step 62) to decrease the percentage of unburned carbon attributable to the burner. Various techniques for implementing this step are discussed below. To compensate for the increased air-to-fuel ratio at the adjusted burner, the air-to-fuel ratio at another burner is reduced (step 64) such that a substantially constant total air-to-fuel ratio is preserved. Since the overall combustion air input to the boiler is substantially constant, boiler efficiency is not compromised. Thus, boiler efficiency is preserved, while emission levels are decreased.

Locating a burner that produces a disproportionately high quantity of unburned carbon (step 60) may be done in the following manner. The UBC levels may be quantified via field measurements for the specific boiler of interest. Thereafter, a commercially available three-dimensional combustion fluid dynamic module is used to converge a "base case" which yields UBC levels that are consistent with the field measurements. The combustion fluid dynamic module may then be used to identify the "critical burners", which are defmed as those burners responsible for producing a disproportionate quantity of UBC. Computer code (e.g., Combustion Fluid Dynamic (CFD) code) is used to build a model of the burners and boiler. All physical dimensions of the burners and boiler are used as input to this model, as is plant process data, including air and fuel flows, temperatures and pressures, steam side conditions, and fuel properties. The computer (30) may be used to execute a three-dimensional combustion fluid dynamic module (38), such as GLACIER CODE, sold by Reaction Engineering, Salt Lake City, Utah; COMO CODE, sold by Babcock and Wilcox, Alliance, Ohio; or COMBUST CODE, sold by Air Flow Sciences Corporation, Detroit, Mich.

Initially, a base case model is developed and the resulting combustion temperatures and emissions are compared to field data to insure that a representative base case has been produced. From analysis of this base case, the burner or burners contributing to the unburned carbon may be identified. Parametric cases can then be run to determine air flow, fuel flow, or fuel characteristics (such as particle size distribution) or burner or boiler modifications to reduce the unburned carbon levels. Typically, the air-to-fuel ratios of specific burners are increased while others are decreased to maintain the overall boiler excess air and NOx levels.

A number of techniques may be used to increase the air-to-fuel ratio at the identified critical burner. One technique is to increase the amount of oxygen discharged at the critical burner. This results in the fuel particle of that boiler being exposed to higher oxygen levels, resulting in a reduction in unburned carbon. Another technique to increase the air-to-fuel ratio at the identified critical burner is to eliminate the coarse fraction of pulverized coal fed to the burner, and thereby rely upon relatively small coal particles. A reduction in large particles increases the oxidation history of the utilized particles via an increase in oxidizing surface area to particle mass ratio. Relatively small coal particles used in this embodiment have a diameter less than approximately 250 micro-meters in diameter. Elimination of the coarse fraction of the pulverized coal can be achieved with the coal classifier (50) of FIG. 2 or by improving the performance of the classifier. A single coal classifier 50 may be used for a number of burners.

The operation of reducing the air-to-fuel ratio at a non-critical burner to offset the effect of the increased air-to-fuel ratio at a critical burner may be achieved by a number of techniques. One technique is to decrease the amount of oxygen discharged at the critical burner. Another technique is to utilize the coarse fraction (e.g., coal particles with a diameter greater than approximately 250 micro-meters in diameter) of pulverized coal fed to the non-critical burner.

Other system modifications to increase the oxidation history of key coal particles may be identified from computer model analyses. Such system modifications include alternate placement of overfire air ports or changes to the overfire air distribution.

Those skilled in the art will appreciate that the invention reduces unburned carbon in a low NOx boiler, while allowing the boiler to operate with the same low NOx emissions. The fly ash generated by the boiler can be sold at a profit, instead of being disposed of at a considerable expense. Advantageously, the technique of the invention can be readily exploited in existing and future low NOx systems.

The foregoing description, for purposes of explanation, used specific nomenclature to provide a thorough understanding of the invention. However, it will be apparent to one skilled in the art that the specific details are not required in order to practice the invention. In other instances, well known circuits and devices are shown in block diagram form in order to avoid unnecessary distraction from the underlying invention. Thus, the foregoing description of specific embodiments of the present invention are presented for purposes of illustration and description. They are not intended to be exhaustive or to limit the invention to the precise forms disclosed, many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A method to reduce unburned carbon in a low NOx boiler, said method comprising the steps of:

locating a first burner that produces a higher quantity of unburned carbon than other burners of the low NOx boiler;

increasing the air-to-fuel ratio at said first burner to decrease a percentage of unburned carbon attributable to said first burner; and reducing the air-to-fuel ratio at a second burner of said low NOx boiler to maintain a substantially constant total air-to-fuel ratio in said low NOx boiler.

2. The method of claim 1 wherein said locating step includes the step of operating a three-dimensional combustion fluid dynamic module to locate said first burner.

3. The method of claim 1 wherein said increasing step includes the step of increasing oxygen discharged at said first burner.

4. The method of claim 1 wherein said increasing step includes the step of eliminating a coarse fraction of pulverized coal fed to said first burner.

5. The method of claim 1 wherein said increasing step includes the step of classifying coal mill discharge that produces a burner feed stream for said first burner, such that substantially all fuel particles in said burner feed stream are less than 250 micro-meter in diameter.

* * * * *